US008171983B2

(12) United States Patent
Kawa et al.

(10) Patent No.: US 8,171,983 B2
(45) Date of Patent: May 8, 2012

(54) CASTING DIE FOR CONTINUOUS CASTING OF BLOOMS, SLABS, AND BILLETS

(75) Inventors: Franz Kawa, Adliswil (CH); Adalbert Roehrig, Thalwil (CH)

(73) Assignee: SMS Concast AG, Zurich (CH)

( * ) Notice: Subject to any disclaimer, the term of this patent is extended or adjusted under 35 U.S.C. 154(b) by 182 days.

(21) Appl. No.: 12/602,804

(22) PCT Filed: May 21, 2008

(86) PCT No.: PCT/EP2008/004067
§ 371 (c)(1),
(2), (4) Date: Dec. 21, 2009

(87) PCT Pub. No.: WO2008/148465
PCT Pub. Date: Dec. 11, 2008

(65) Prior Publication Data

US 2010/0155570 A1 Jun. 24, 2010

(30) Foreign Application Priority Data

Jun. 4, 2007 (CH) ..... 0906/07

(51) Int. Cl.
*B22D 11/055* (2006.01)
*B22D 11/124* (2006.01)

(52) U.S. Cl. ..... 164/443; 164/348; 164/418

(58) Field of Classification Search ..... 164/418, 164/459, 443, 485, 348
See application file for complete search history.

(56) References Cited

U.S. PATENT DOCUMENTS 6,173,756 B1 * 1/2001 Fehlemann ..... 164/443

FOREIGN PATENT DOCUMENTS

EP 1 025 929 * 8/2000

* cited by examiner

*Primary Examiner* — Kuang Lin
(74) *Attorney, Agent, or Firm* — Brian Roffe

(57) ABSTRACT

A mold for the continuous casting of blooms, slabs or billets is provided with a mold tube (2) and a supporting shell (4) surrounding said mold tube. The mold tube (2) is supported by support profiles (15) on the supporting shell (4) extending in its longitudinal direction and distributed over the periphery and is positively connected thereto via connecting profiles (20) extending in the longitudinal direction. The connecting profiles (20) are respectively configured as profile strips (21, 22) outwardly projecting from the outer periphery of the mold tube (2) and inwardly projecting from the inner periphery of the supporting shell (4), which engage in one another such that in the peripheral direction of the mold a clearance is present. As a result, the stresses, permanent deformation and fatigue cracks produced by the thermal expansion in the mold tube are substantially avoided.

20 Claims, 10 Drawing Sheets

CASTING DIE FOR CONTINUOUS CASTING OF BLOOMS, SLABS, AND BILLETS

The invention relates to a mould for the continuous casting of blooms, slabs or billets according to the preamble of Claim 1.

Continuous casting moulds are known to be subjected to considerable thermal loads during operation as a result of the molten metal solidifying in the mould cavity. Consequently, said thermal loads cause thermal expansion of the mould walls and thus lead to deformations of the accurately produced mould cavity. Particularly undesirable are deformations transversely to the direction of casting, as they alter the conicity of the mould which is important for the solidifying process. Therefore, particular measures have to be taken in order to stabilise the mould walls in their position.

It is known from the generic EP-B1-1 468 760 to arrange a supporting shell around the copper mould tube forming the mould cavity, on which the mould tube is supported by support profiles extending in its longitudinal direction and distributed over the periphery. The mould tube is positively connected to the supporting shell via connecting profiles extending in the longitudinal direction, cooling ducts being arranged between the mould tube and the supporting shell for guiding cooling water, which are defined by the support profiles and/or the connecting profiles. The connecting profiles are, for example, configured as dovetail profiles or T-profiles which engage in corresponding grooves of the supporting shell. They are inserted into the grooves in the longitudinal direction of the mould. This assembly is not always straightforward, as it results in friction on sealing elements provided between the mould walls and the supporting shell. The mould tube walls are respectively not only secured in the direction perpendicular to the casting axis, but also prevented from thermal expansion in the wall plane and/or supporting plane, transversely to the casting axis. The latter may lead to stresses and permanent deformation and fatigue cracks of the mould tube.

The object of the present invention is to provide a mould of the aforementioned type which, during the casting operation, has a high degree of dimensional stability and in which, however, deformations caused by thermal expansion of the mould walls may be substantially avoided.

This object is achieved according to the invention by a mould with the features of Claim 1.

Further preferred embodiments of the mould according to the invention form the subject-matter of the dependent claims.

According to the invention, the connecting profiles are respectively configured as two profile strips outwardly projecting from the outer periphery of the mould tube and inwardly projecting from the inner periphery of the supporting shell, which engage in one another such that in the peripheral direction of the mould a clearance is present. As a result of the profile strips, the mould tube walls are held against the walls of the protective cover supporting said mould tube walls in the direction perpendicular to the casting axis, but a displacement along the mould wall caused by thermal expansion is possible, primarily in the longitudinal direction of the mould, but also within the clearance provided transversely thereto in the peripheral direction of the mould. As a result, the stresses, the permanent deformations and fatigue cracks caused by the thermal expansion in the mould tube are substantially avoided. Not least, the assembly of the mould is also simplified.

The invention is described hereinafter in more detail with reference to the drawings, in which.

Figure 7A:
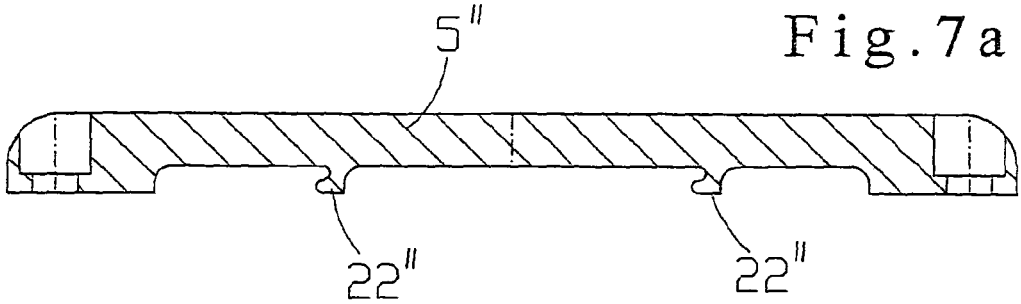
Figure 7B:
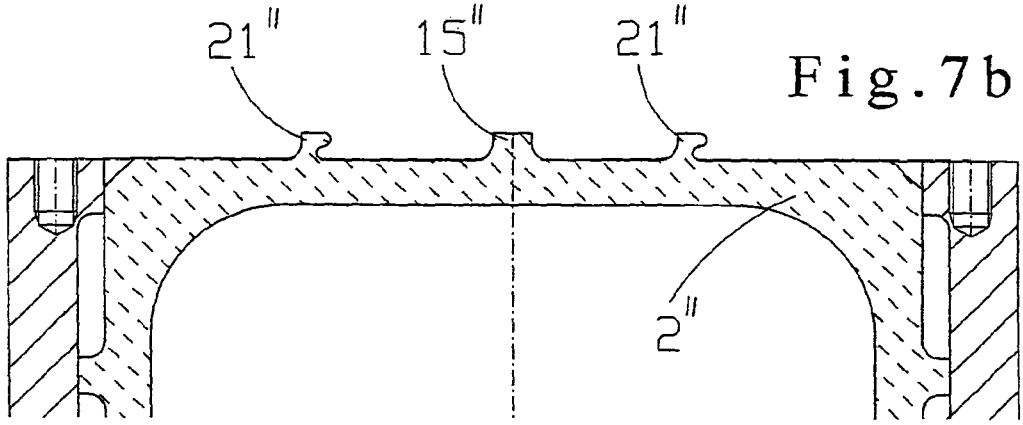
Figure 7C:
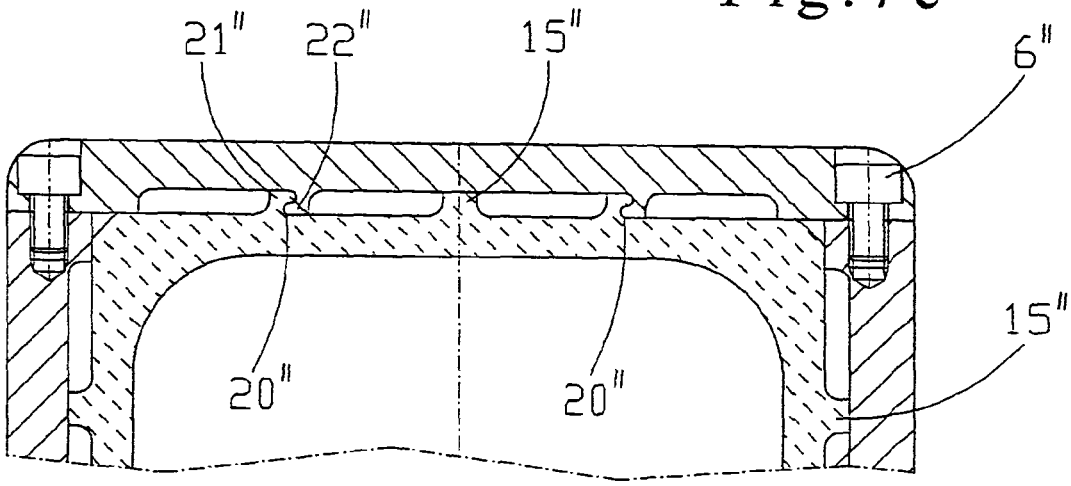
Figure 8A:
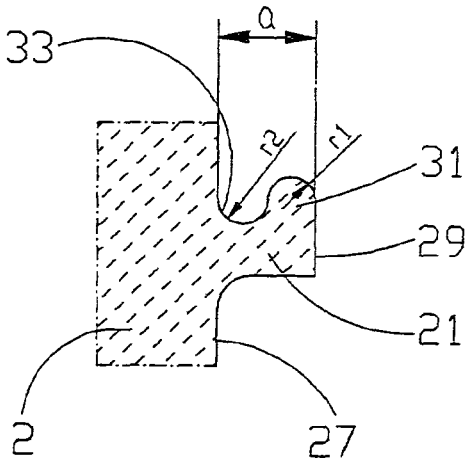
Figure 8B:
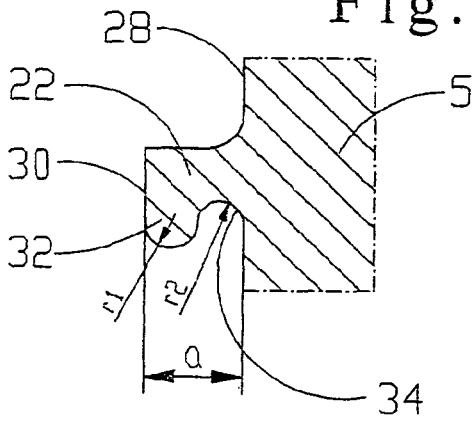
Figure 9A:
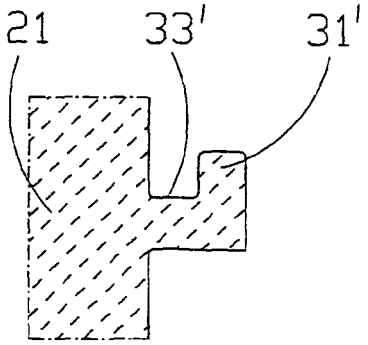
Figure 9B:
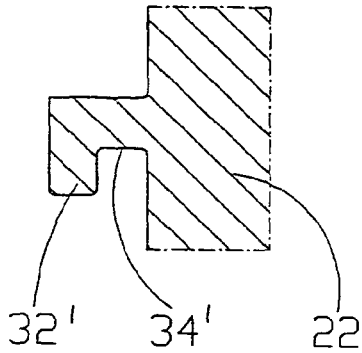
Figure 10:
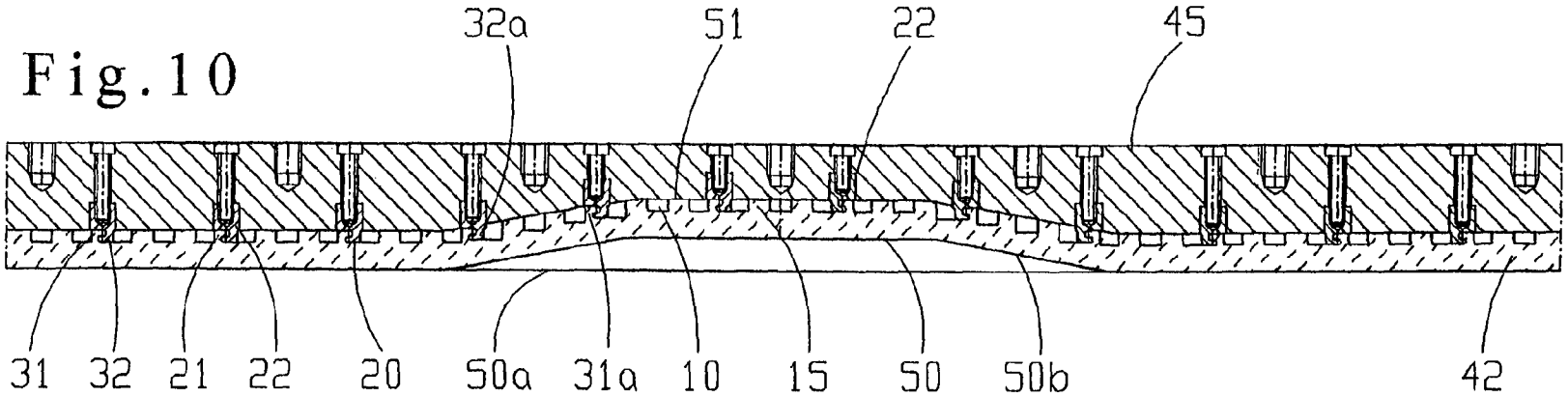
Figure 11:
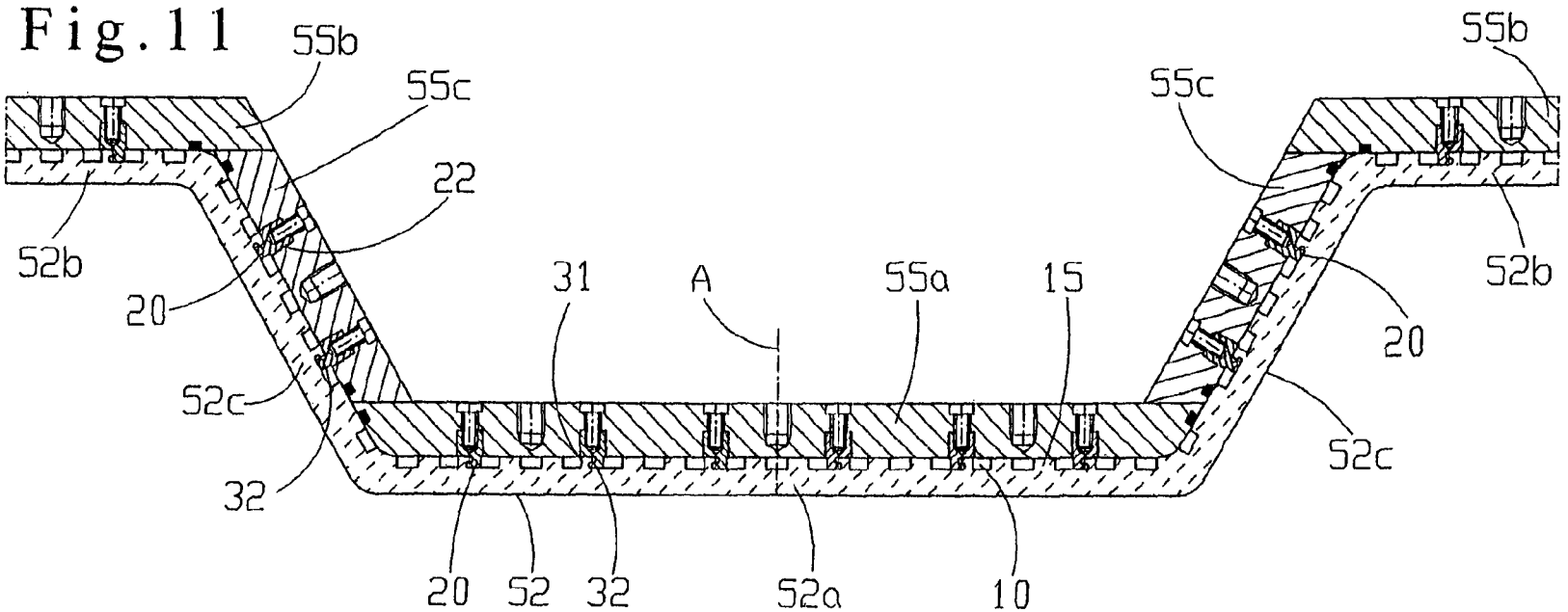
Figure 12:
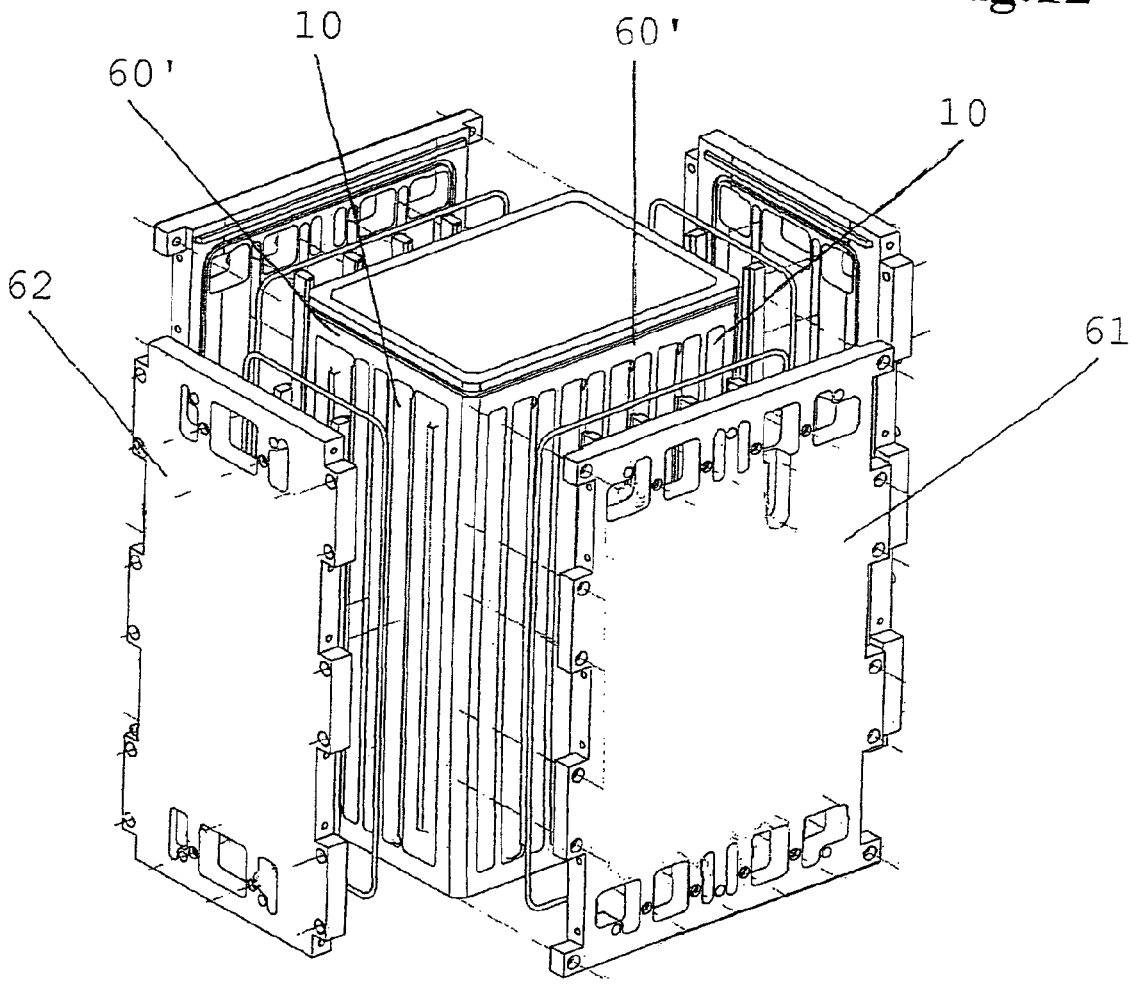
Figure 13:
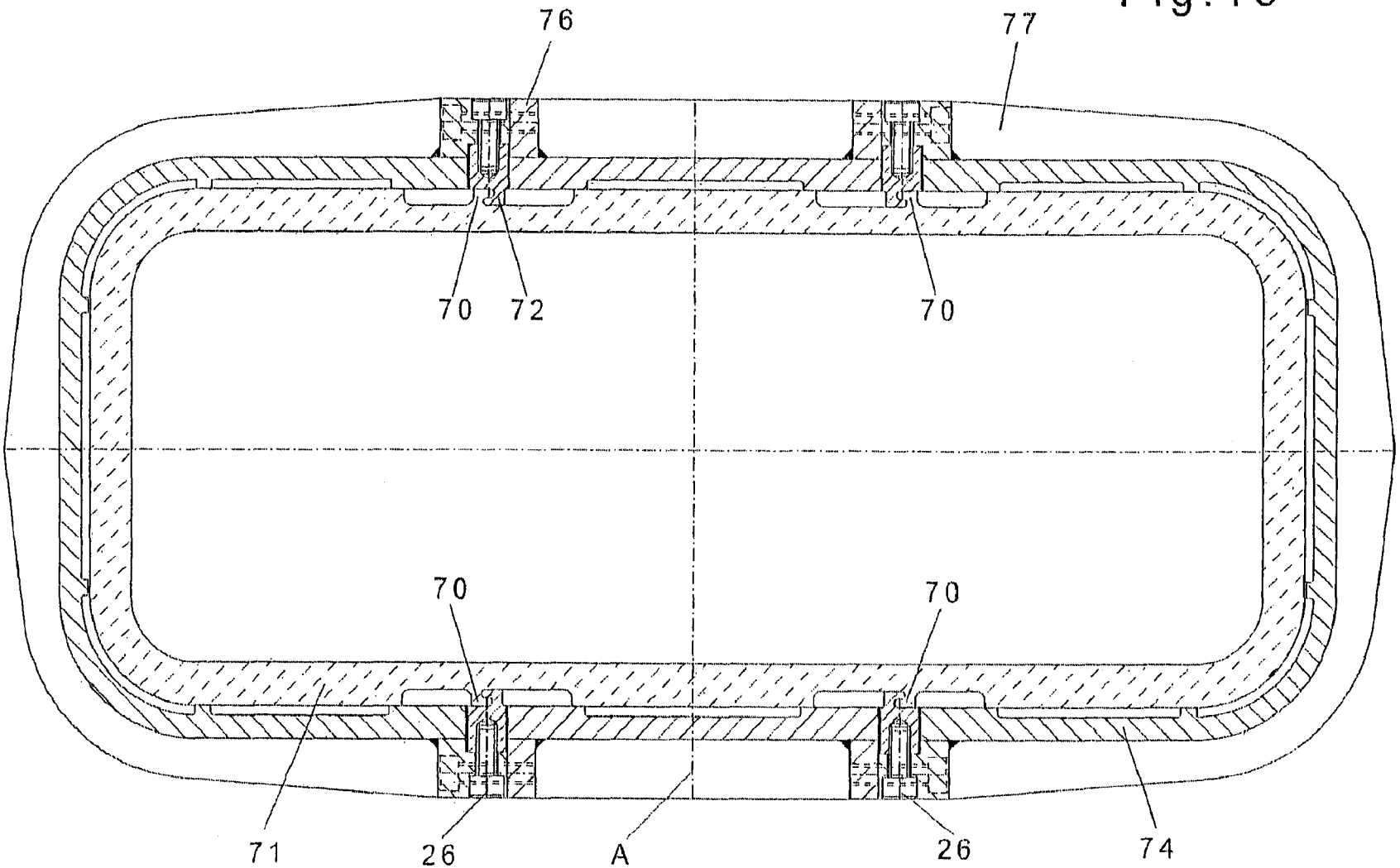

FIGS. 7*a*, 7*b*, 7*c* show a support plate and a part of the mould tube with two further support plates separated from one another as well as in an assembled state according to a further embodiment;

FIGS. 8*a*, 8*b* show in horizontal cross section a first embodiment of connecting profiles for connecting the mould tube to the supporting shell;

FIGS. 9*a*, 9*b* shows in horizontal cross section a second embodiment of connecting profiles for connecting the mould tube to the supporting shell;

FIG. 10 shows a mould plate for a plate mould with a corresponding support plate;

FIG. 11 shows a further embodiment of a mould wall for a plate mould with corresponding support plates;

FIG. 12 shows an embodiment of a mould according to the invention in perspective view with a mould tube and four support plates, and FIG. 13 shows a further embodiment of a mould tube which is rectangular in cross section with the supporting shell in horizontal cross section.

In FIGS. 1 to 4, a mould 1 is shown for the continuous casting of blooms, slabs or billets of rectangular cross section, which comprises a mould tube 2 made of copper, which forms a mould cavity 3, as well as a supporting shell 4 surrounding the mould 2. The supporting shell 4 is made up of four support plates 5, 5', which are connected to one another by means of screws 6. Between the mould tube 2 and the supporting shell 4, cooling ducts 10 are provided for guiding cooling water, which form part of a water circulation cooling system for the copper tube, and which are distributed over the entire periphery and substantially over the entire length of the mould tube 2 (see in particular FIGS. 2 and 4). The support plates 5, 5' are provided in the upper region and in the lower region with inlets and outlets 11, 12 connected to the cooling ducts 10, for the cooling water.

In the embodiment shown, the cooling ducts 10 are incorporated, for example machined, in the outer peripheral surface of the mould tube 2. The mould tube 2 is, on the one hand, supported via support profiles 15 on the supporting shell 4 and/or on the support plates 5, 5' extending in the longitudinal direction L thereof and distributed over the periphery and, on the other hand, said mould tube is releasably positively connected to said support plates 5, 5' via connecting profiles 20 extending in the longitudinal direction. The cooling ducts 10 are in this case laterally defined by the support profiles 15 and/or the connecting profiles 20.

According to the invention, the connecting profiles 20 are respectively configured as two profile strips 21, 22 which engage in one another, outwardly projecting from the outer periphery of the mould tube 2 and inwardly projecting from the inner periphery of the supporting shell 4. They are distributed over the respective mould side, the number thereof per side being dependent on the size of the mould. In the mould 1 which is rectangular in cross section, for example according to FIG. 2, the wider support plates 5 are each provided with four connecting profiles and the narrower support plates 5' are each provided with two connecting profiles 20.

Figure 5:
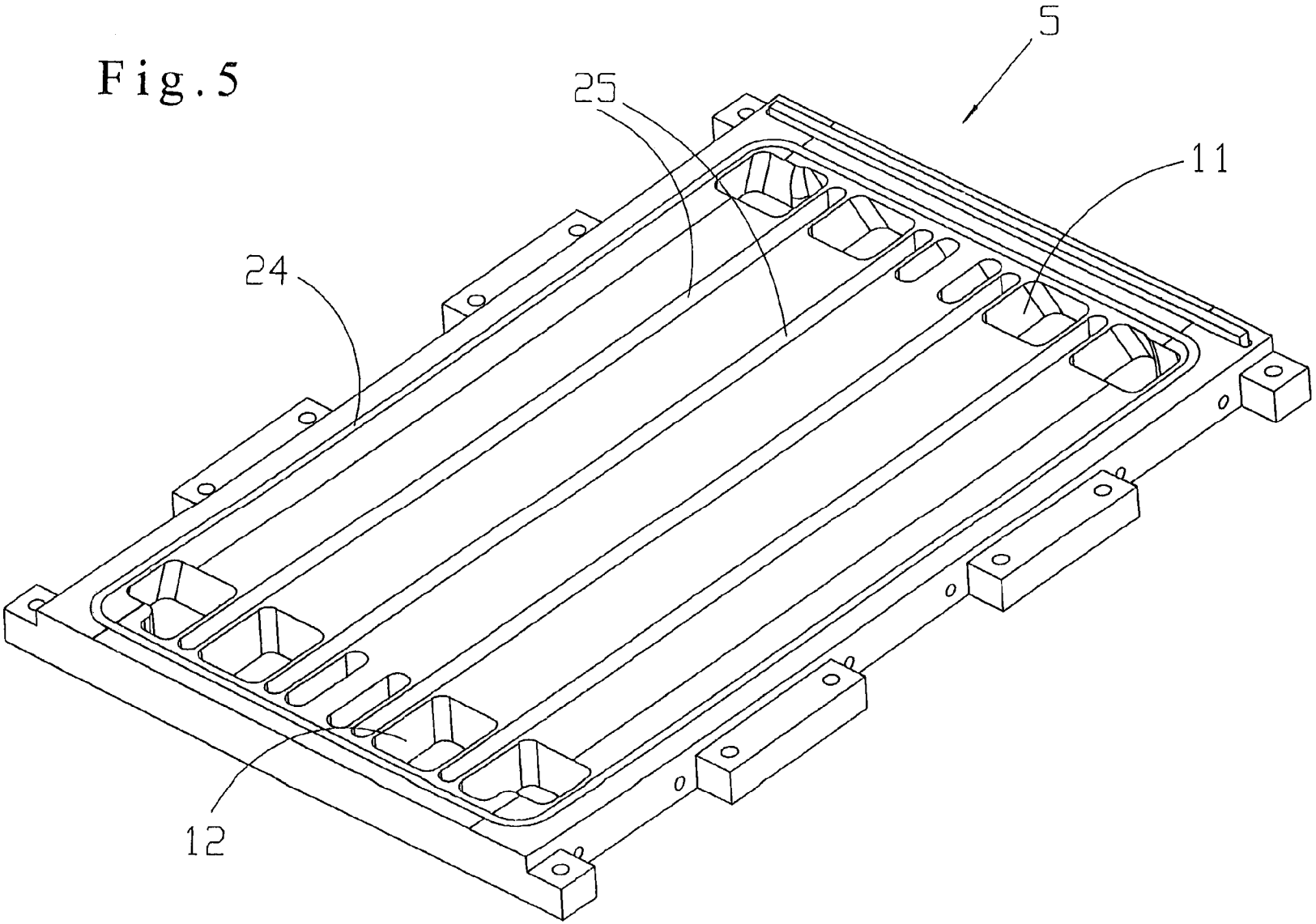
FIG. 5 shows one of the support plates in perspective view.

The profile strips 21, 22 are preferably of nose-shaped configuration in cross section (as is described in more detail below with reference to FIGS. 8*a*, 8*b* and 9*a*, 9*b*) and engage in one another such that in the peripheral direction of the mould 1*a* clearance is present. The mould walls are held in the position resting against the support plates 5, 5' in the direction perpendicular to the casting axis, but a mutual displacement along the mould wall caused by thermal expansion is possible, primarily in the longitudinal direction L of the mould, but also within the clearance provided transversely thereto, in the peripheral direction of the mould. In order to permit this displacement, the mould tube 2 is held in the corner regions thereof with a corresponding clearance relative to the supporting shell 4. Each of the support plates 5, 5' is advantageously provided in its peripheral region with a sealing ring 23, 23' sealing the cooling zone, which is inserted into a channel 24 visible from FIG. 5 which shows the support plate 5.

Figure 1:
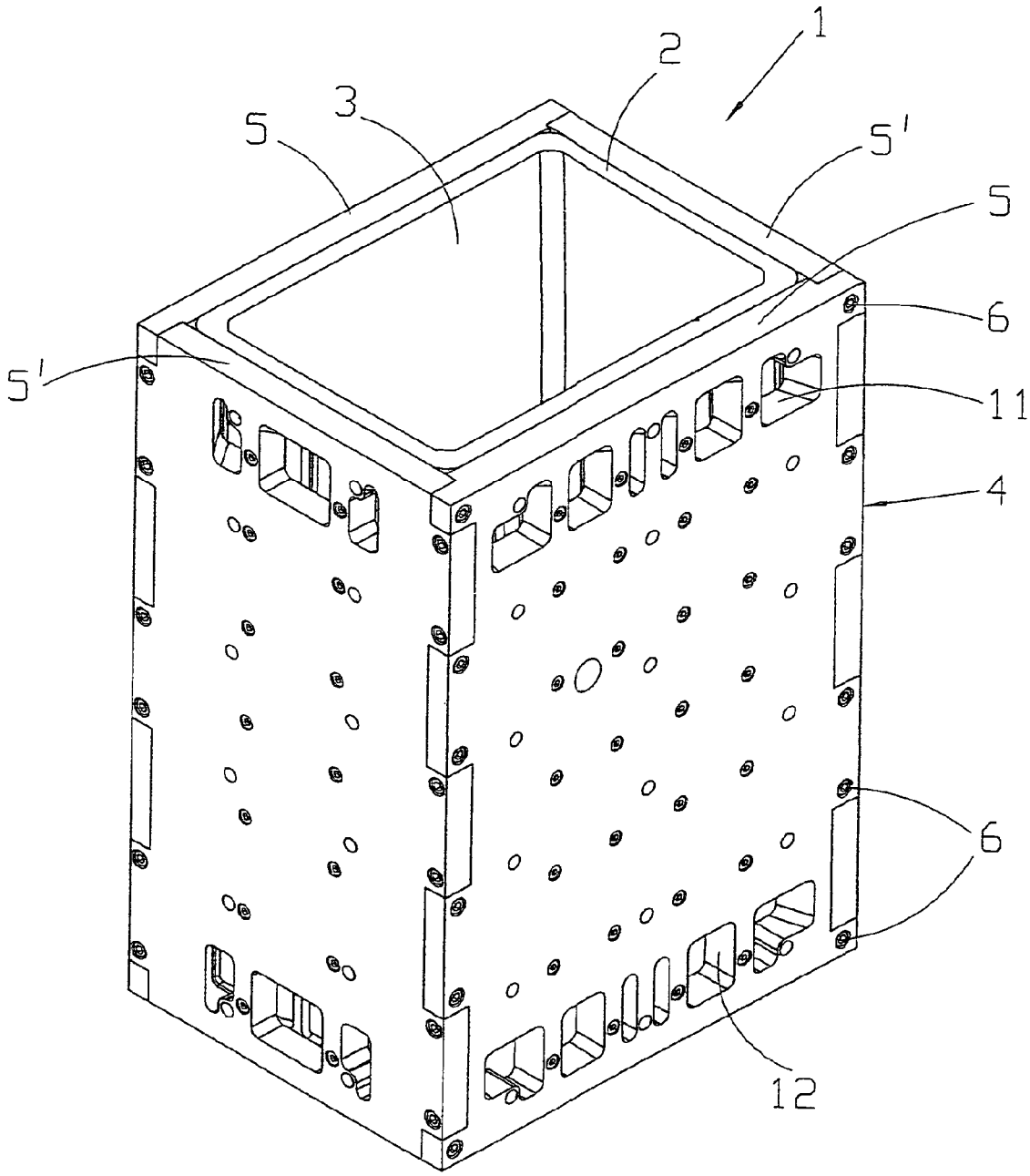
FIG. 1 shows in a perspective view an embodiment of a mould according to the invention with a mould tube and a supporting shell made up of four support plates.
Figure 2:
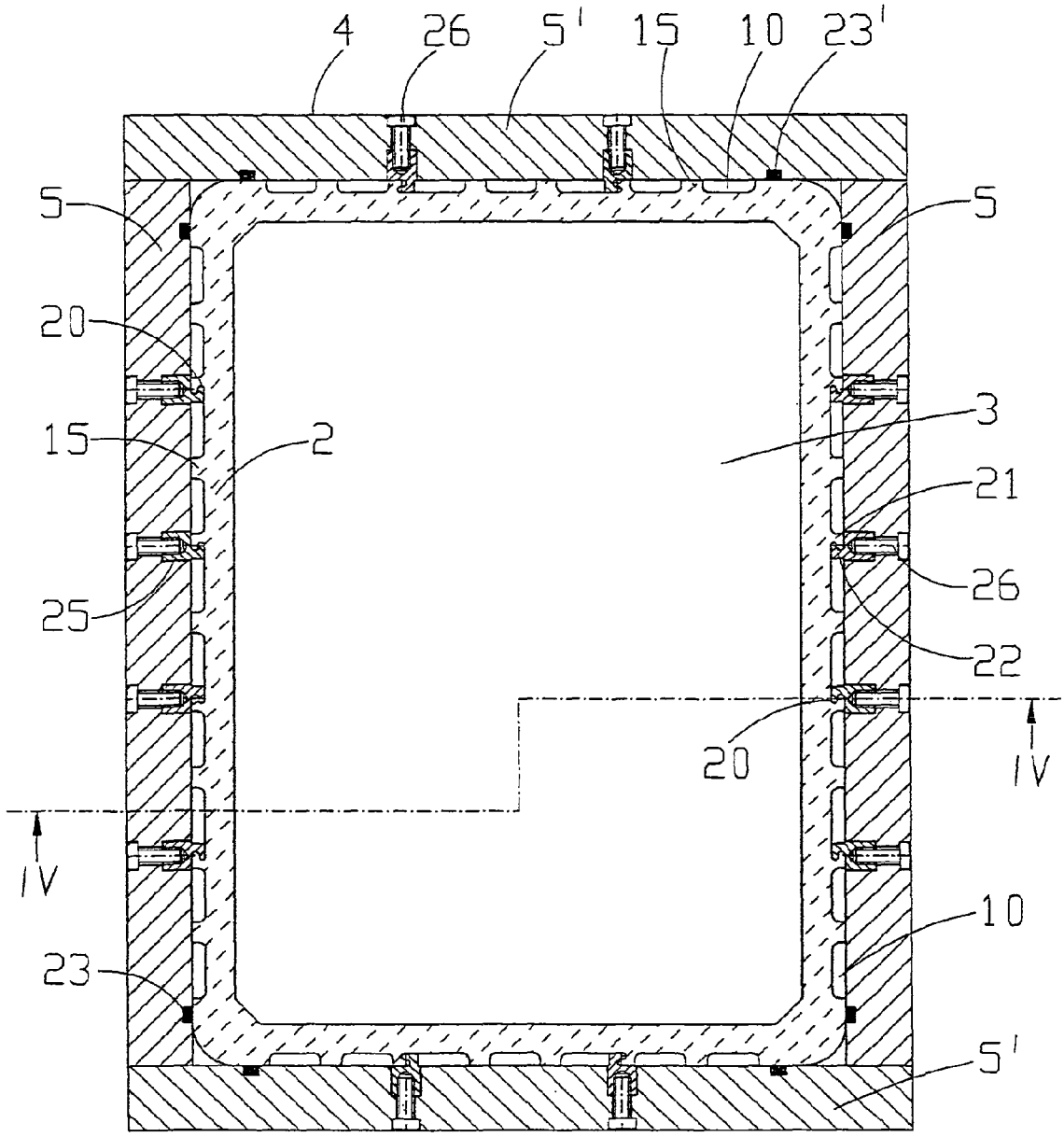
FIG. 2 shows the mould according to FIG. 1 in horizontal cross section.
Figure 3:
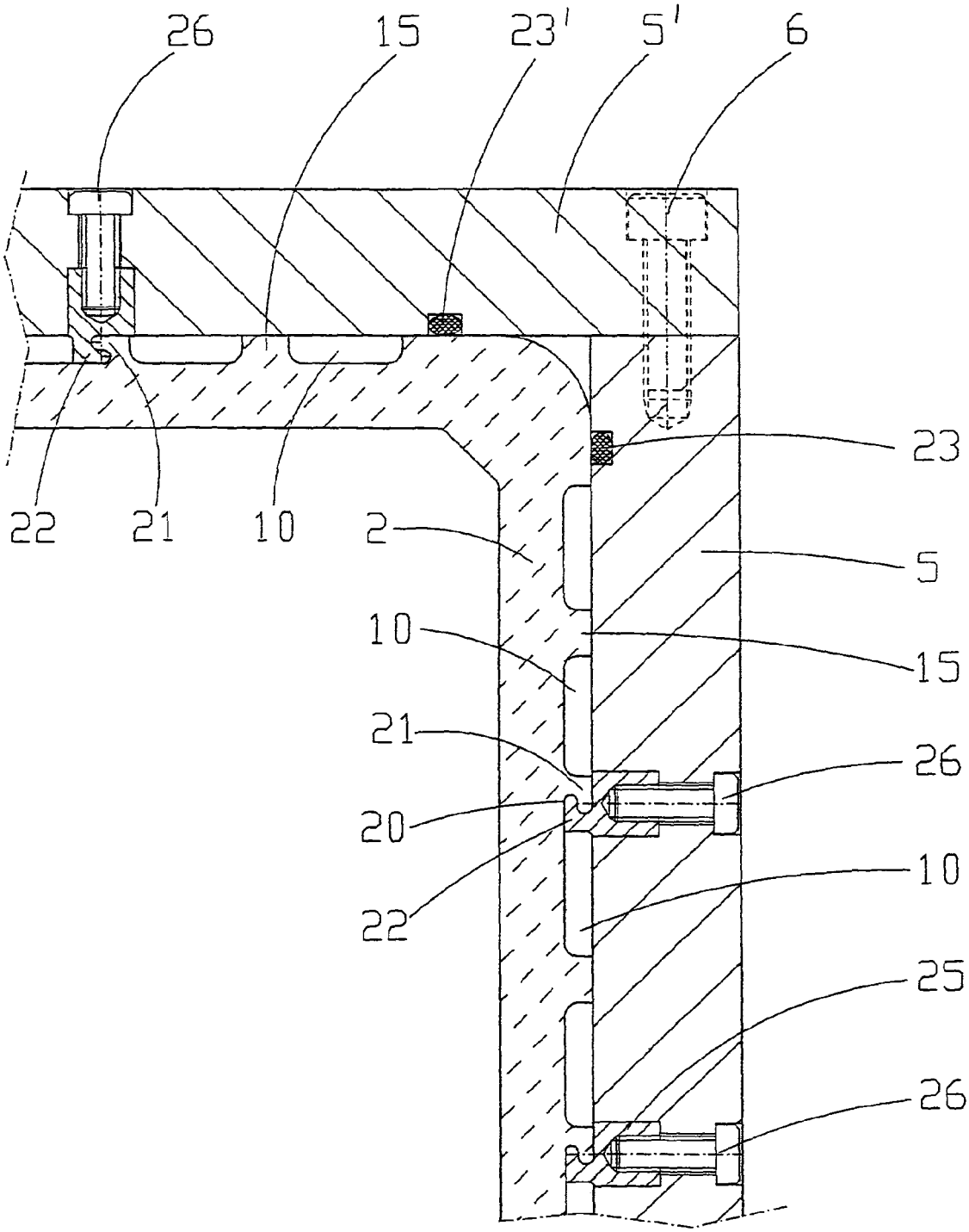
FIG. 3 shows a horizontal partial section according to FIG. 2 in enlarged scale.
Figure 4:
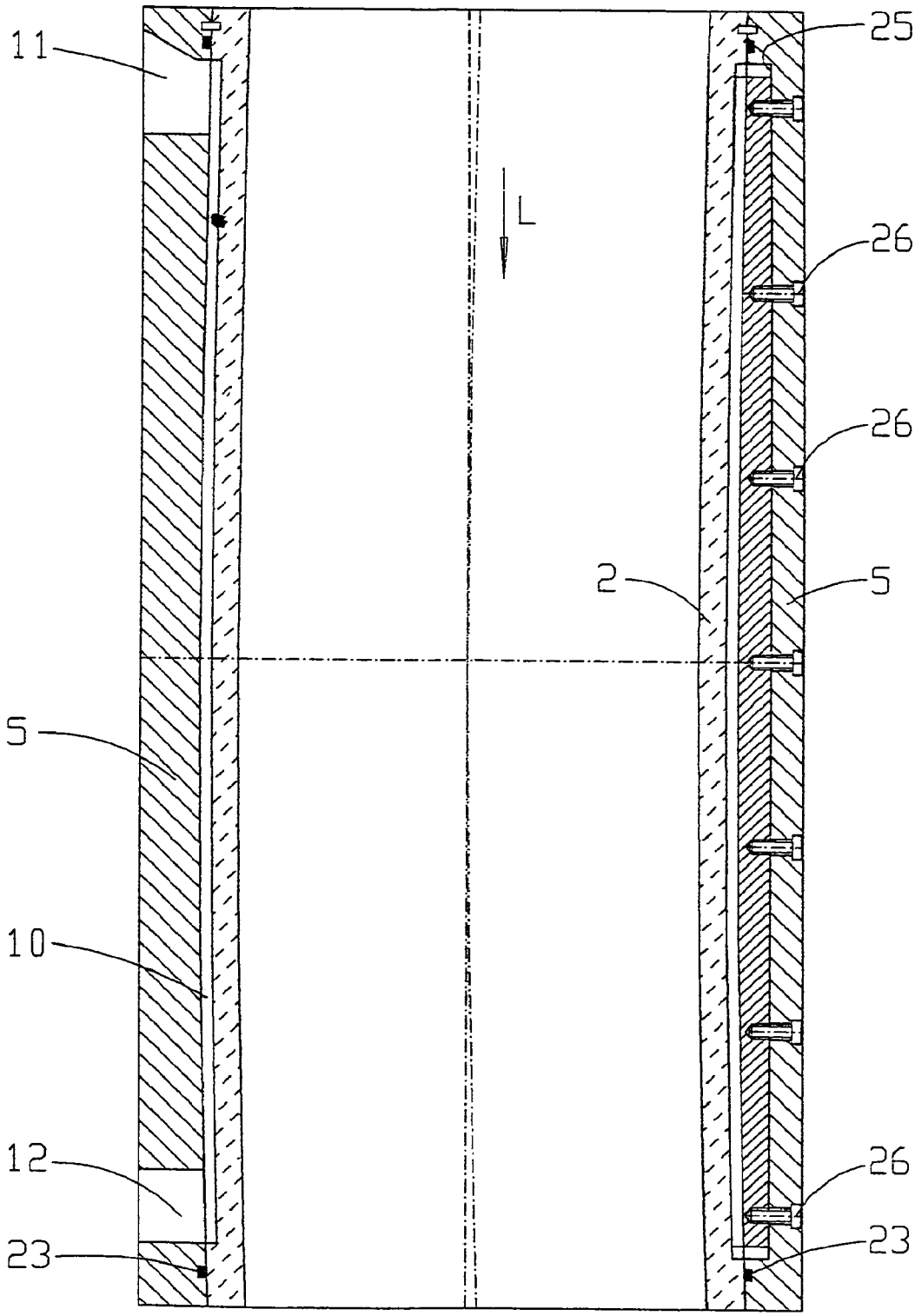
FIG. 4 shows the mould according to FIG. 1 in vertical cross section along the line IV-IV in FIG. 2.

While the profile strips 21 are directly manufactured on the mould tube 2, i.e. are integral with the mould tube 2, in particular with large-sized moulds and with the presence of sealing rings 23, 23', it is advantageous in terms of assembly to design the profile strips 22 for the support plates 5, 5' separately, such as for example shown in FIGS. 2 to 4. These are then inserted into corresponding recesses 25 of the support plates 5, 5' and connected by means of screws 26 distributed over the entire strip length to the support plates 5, 5'. In this case, during the assembly no lateral displacement of the support plates 5, 5' on the sealing rings 23, 23' is required as the previously inserted profile strips 22 now only have to be tightened against the support plates 5, 5'.

As shown in FIGS. 6 and 7*a*, 7*b*, 7*c*, however, in particular with smaller moulds it is perfectly possible to manufacture the profile strips 22 for the support plates 5, 5' directly on the support plates 5, 5', i.e. to configure said profile strips integrally with the respective support plate 5, 5'.

Figure 6:
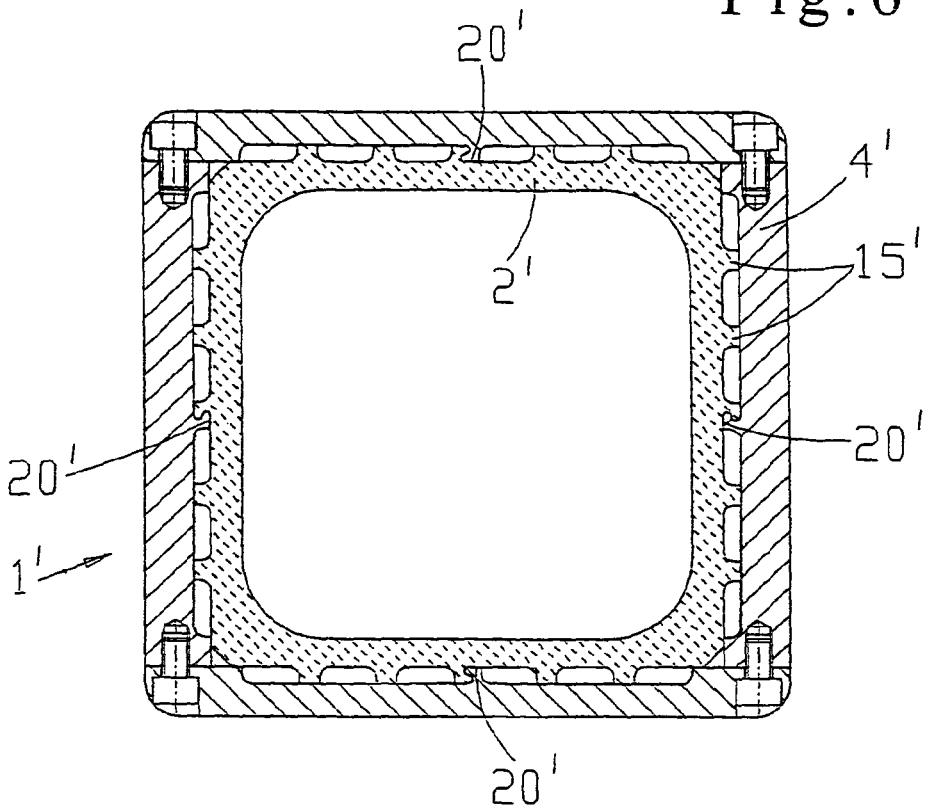
FIG. 6 shows a second embodiment of a mould according to the invention in horizontal cross section.

In the smaller mould 1' shown in FIG. 6, of square cross section, respectively only one connecting profile 20' is present, consisting of two profile strips engaging in one another, for each mould side (and a plurality of support profiles 15'). The connecting profiles 20' connecting the mould tube 2' to the supporting shell 4', are respectively arranged in the central region of the respective mould wall.

As required, according to FIGS. 7*a*, 7*b*, 7*c* a plurality of connecting profiles 20" may also be provided for each mould side, which consist of profile strips 21" integrally configured with the mould tube 2" and profile strips 22" integrally configured with the respective support plate 5". The mould tube 2" may comprise just one support profile 15" per side arranged in the centre region or a plurality of support profiles 15".

In the embodiments according to FIGS. 6 and 7*a*, 7*b*, 7*c*, during assembly the respective support plate 5" has to be displaced laterally relative to the mould tube wall, until the profile strips 21", 22" are engaged. Even with the presence of sealing rings, in this case the assembly is substantially simpler than in the moulds known from EP-B1-1 468 760, relative to which there is no comparison between the amount of lateral displacement in the mould according to the invention and the longitudinal displacement during assembly according to EP-B1-1 468 760. Additionally, the respective support plate 5" may be slightly obliquely positioned until engaged and as a result friction on the sealing ring is avoided.

Particularly advantageous cross-sectional shapes of the profile strips 21, 22 are visible from FIGS. 8*a*, 8*b* and 9*a*, 9*b*. The profile strips 21, 22 which are nose-shaped in cross section, project by an amount a from a bottom surface 27 and/or 28 of the mould tube 2 and/or the support plate 5. The profile strip 21 of the mould tube 2 has a support face 29 with which it rests in the assembled state against the bottom surface 28 of the support plate 5 and vice versa, the support plate 5 comes to bear with a support face 30 on the bottom surface 27 of the mould tube 2. The profile strips 21, 22 respectively have a rounded nose 31 and/or 32 which is oriented in the peripheral direction of the mould, with a radius $r_1$, which is engaged from behind by a similarly rounded recess 33 and/or 34 opposing the nose in the peripheral direction with a radius $r_2$. The radius $r_2$ of the recesses 33, 34 is in this case slightly greater than the radius $r_1$ of the two noses 31, 32. When joining the two profile strips 21, 22, the nose of the one profile strip engages in the recess of the other profile strip, and namely with a lateral clearance of, for example, ±0.1 mm, which is produced from the difference of the two radii $r_1$, $r_2$, so that within this clearance a mutual displacement caused by thermal expansion may occur along the mould wall in the peripheral direction of the mould.

Naturally, a mutual displacement caused by thermal expansion in the longitudinal direction of the profile strips 21, 22 is also possible, i.e. in the longitudinal direction of the mould. In this manner, stresses, plastic deformation and fatigue cracks in the mould tube, which are otherwise caused by the thermal expansion, are avoided.

The size of the mould is important for the amount of lateral clearance. With larger moulds, a larger clearance has to be additionally ensured. A possible cross-sectional shape of the nose-shaped profile strips 21, 22 for larger moulds is shown in FIGS. 9*a*, 9*b*, where the nose 31' and/or 32' of the one profile strip 21 and/or 22 is able to engage respectively in the recess 34' and/or 33' of the other profile strip 22 and/or 21 with greater clearance in the peripheral direction.

Instead of an integral mould tube 2 and/or 2' and/or 2", it is also possible and perfectly usual to make up the mould forming the mould cavity as a plate mould with mould tube walls formed from individual copper plates or the like. One or more support plates are thus associated with the individual mould plates and/or mould tube walls, which form the supporting shell around the plate moulds.

FIG. 10 shows as an example a mould plate 42 of a plate mould for continuous casting of thin slabs. The longitudinal sides of such moulds are 1 to 2 m and the narrow sides only 50 to 10 mm wide. The mould plates 42 on the longitudinal sides are provided in the upper region with a bulged portion 50 for the immersion tube, i.e. the extension of the mould tube wall is not straight in all parts. Also, the support plate 45 associated with the mould plate 42 is provided on the inner face with a corresponding recess 51. The cooling ducts 10 are in turn provided between the mould plate 42 and the support plate 45, and which are defined by the support profiles 10 and/or the connecting profiles 20.

According to the invention, the connecting profiles 20 are, in turn, configured as two profile strips 21, 22 engaging in one another with noses 31, 32 oriented in the peripheral direction of the mould and engaging in one another with clearance. In the oblique region of the bulged portion 50 and/or of the recess 51, the noses 31, 32 are also obliquely oriented, parallel to the mould inner surface 50*a*, 50*b*. Thus it is also possible for this wide and relatively thin copper plate, which is subjected to significant thermal expansion relative to the more solid steel support plate, actually to expand along the mould wall. In this variant, it is naturally advantageous to design the profile strips 22 for the support plate 45 separately and to insert said profile strips into the support plate 45.

FIG. 11 shows a copper mould tube wall 52 of a plate mould for the continuous casting of preliminary double-T sections, which has a web part 52*a*, two flange parts 52*b* and one respective oblique part 52*c* connecting the web part 52*a* to the respective flange part 52*b*. A support plate 55*a* is associated with the web part 52*a*. The flange parts 52*b* are also provided with one respective support plate 55*b*. Between the support plate 55*a* for the web part 52*a* and the support plate 55*b* for the flange parts 52*b*, respectively one support plate 55*c* is arranged extending along the oblique parts 52*c* and overlapped by the adjacent support plates 55*a*, 55*b*. Even in this case, the support profiles 10 and/or the connecting profiles 20 are present, said connecting profiles being configured as two profile strips 21, 22 engaging in one another with noses 31, 32 oriented in the peripheral direction of the mould and engaging in one another with clearance. The noses 31, 32 are also in this case always oriented parallel to the mould inner surface in the peripheral direction of the mould, even in the region of the oblique parts 52*c*. In contrast to the embodiment of FIG. 10, however, the profile strips 22 are always perpendicular to the respective wall part. Thus, with this shape of mould, consideration also has to be given to the thermal expansion of the entire area of the individual mould walls of the mould tube.

Both with the plate mould according to FIG. 10 and with the plate mould according to FIG. 11, the noses 31, 32 are arranged symmetrically relative to the centre plane (A) extending transversely to the longitudinal extension of the mould which is of elongate configuration.

FIG. 12 shows a mould tube 60 with a mould cavity 3 which per se is designed in the same manner as that according to FIG. 1 to FIG. 5, and thus not described further in detail. As a particularity, however, the support plates 61, 62 are not configured as a supporting shell forming a box, but they are fastened independently from one another by means of the profile strips according to the invention to the four external walls 60' of the mould tube 60 which are respectively present. These support plates 61, 62 are advantageously designed to be trapezoidal in horizontal cross section and form a planar surface resting on the respective outer wall 60' of the tube 60, so that the cooling ducts 10 machined into the outer face in the tube 60 are covered thereby. These support plates 61, 62 thus form only one type of reinforcement of the relatively thin-walled mould tube.

The mould tube 60 is held together with the support plates 61, 62 in a mould housing, not shown in more detail, which is in two parts and, to this end, may comprise a centre flange, not shown, which surrounds the support plates 61, 62. The cooling water in the inside of the mould housing is conducted upwards on the lower face through the cooling ducts 10 of the tube and reaches the mould housing again on the upper face.

In this variant according to FIG. 12, a simplified embodiment of a mould, in particular, results as the support plates 61, 62 are not connected to one another. Naturally, these support plates could also be of different design, for example by the cooling ducts being associated with these support plates.

A further mould 1" with an elongate rectangular cross section according to FIG. 13 has a mould tube 71 and a supporting shell 74 surrounding said mould tube, the supporting shell 74 being divided in its longitudinal direction at the points 74' and thus consisting of four cover parts which are screwed together at these points 74'.

The particularity of this mould 1" is that according to the invention only on the two elongate sides of the mould 1" are two respective connecting profiles 70 provided, which are arranged symmetrically to the centre axis A of the longitudinal sides. These connecting profiles 70 are configured per se to be the same as those according to FIG. 2 and therefore not explained further in detail. Due to the relatively thin wall of the supporting shell 74, on the outer face thereof, in the vicinity of the connecting profiles 70, longitudinal profiles 76 and moreover transverse profiles 77 are welded. The longitudinal profiles 76 are secured by screws. Naturally, more than two such connecting profiles 70 could also be associated per side.

The invention claimed is:

1. Mould for the continuous casting of blooms, slabs or billets comprising:

a mould component, the mould component including support profiles extending in a longitudinal direction of the mould and being distributed over an outer periphery of the mould component, a supporting structure that surrounds the mould component, the mould component being supported on the supporting structure by the support profiles, the mould component and the supporting structure including cooperating connecting profiles that extend in the longitudinal direction of the mould, the connecting profiles including pairs of engaging profile strips that provide a clearance in a peripheral direction of the mould between the mould component and the supporting structure when engaged, each pair of engaging profile strips including a first profile strip outwardly projecting from an outer periphery of and integral with the mould component and a second profile strip inwardly projecting from an inner periphery of and integral with the supporting structure, and cooling ducts that guide cooling water and are defined by the support profiles and the connecting profiles such that the cooling ducts are arranged at least partly in the clearance between the mould component and the supporting structure.

2. Mould according to claim 1, wherein in each pair of engaging profile strips, the first profile strip and the second profile strip each include a nose projecting in a peripheral direction of the mould and configured such that when the profile strips are engaged, the nose on the first profile strip is situated between the nose on the second profile strip and the supporting structure and the nose on the second profile strip is situated between the nose on the first profile strip and the mould component.

3. Mould according to claim 1, wherein the mould component has a square or rectangular cross-section taken in a plane transverse to the longitudinal direction and has four sides, the supporting structure comprising four support plates each opposite a respective one of the four sides of the mould component, at least one of the connecting profiles being arranged on each side of the mould component.

4. Mould according to claim 3, wherein one of the connecting profiles is arranged in a center region of at least one side of the mould component.

5. Mould according to claim 1, wherein at least one of the cooling ducts is bound by one of the support profiles, one of the connecting profiles, an inner peripheral surface of the supporting structure and an outer peripheral surface of the mould component, and the supporting profiles are spaced apart in a peripheral direction of the mould from the connecting profiles.

6. Mould according to claim 3, wherein the mould component and supporting structure are configured to provide a clearance between the mould component and the supporting structure at a corner region of the supporting structure.

7. Mould according to claim 1, wherein the profile strips substantially extend over the entire length of at least one of the mould component and the supporting structure.

8. Mould according to claim 1, wherein the mould component comprises a plurality of copper plates or mould tube walls and the supporting structure comprises at least one support plate associated with each copper plate or mould tube wall, the first profile strips being arranged on the copper plates or mould tube walls and the second profile strips being arranged on the at least one support plate.

9. Mould according to claim 1, wherein the mould component comprises a plurality of mould tube walls and the supporting structure comprises at least one support plate associated with each mould tube wall, the first profile strips being arranged on the mould tube walls and the second profile strips being arranged on the at least one support plate, and wherein in each pair of engaging profile strips, the first profile strip and the second profile strip each include a nose projecting in a peripheral direction of the mould and configured such that when the profile strips are engaged, the nose on the first profile strip is situated between the nose on the second profile strip and the supporting structure and the nose on the second profile strip is situated between the nose on the first profile strip and the mould component, the nose on the first profile strip being oriented parallel to an inner surface of the mould tube wall.

10. Mould according to claim 9, wherein the noses are arranged symmetrically relative to a centre plane extending transversely to a longitudinal extension of the mould.

11. Mould according to claim 1, wherein the mould component comprises a mould tube and the supporting structure comprises support plates that are fastened independently of one another by means of the profile strips to respective outer walls of the mould tube.

12. Mould according to claim 11, wherein the support plates rest against the mould tube such that the cooling ducts machined into an outer face in the tube are covered by the support plates.

13. Mould according to claim 1, wherein the mould component comprises a mould tube.

14. Mould according to claim 1, wherein the mould component comprises a plate mould.

15. Mould according to claim 1, wherein the supporting structure comprises support plates.

16. Mould according to claim 1, wherein the connecting profiles are associated with only two opposing sides of the mould.

17. Mould according to claim 16, wherein the connecting profiles associated with the two opposing sides of the mould are arranged symmetrically relative to a center axis extending through a center of these two sides.

18. Mould according to claim 1, wherein the supporting structure comprises a supporting shell.

19. Mould according to claim 1, wherein the first profile strips project from an outer peripheral surface of the mould component in an outward direction toward the supporting structure and the second profile strips project from an inner peripheral surface of the supporting structure in an inward direction toward the mould component.

20. Mould according to claim 1, wherein the first and second profile strips are arranged in the clearance between the mould component and the supporting structure provided by the support profiles.

* * * * *